US010722763B2

(12) United States Patent
Abe et al.

(10) Patent No.: US 10,722,763 B2
(45) Date of Patent: Jul. 28, 2020

(54) GOLF CLUB HEAD

(71) Applicant: DUNLOP SPORTS CO. LTD., Kobe-shi, Hyogo (JP)

(72) Inventors: Hiroshi Abe, Kobe (JP); Tatsuhiko Kuwabara, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 222 days.

(21) Appl. No.: 15/704,565

(22) Filed: Sep. 14, 2017

(65) Prior Publication Data

US 2018/0001160 A1 Jan. 4, 2018

Related U.S. Application Data

(62) Division of application No. 14/436,371, filed as application No. PCT/JP2013/078169 on Oct. 17, 2013, now abandoned.

(30) Foreign Application Priority Data

Oct. 17, 2012 (JP) ..... 2012-229374

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 53/047* (2013.01); (Continued)

(58) Field of Classification Search
None
See application file for complete search history.

(56) References Cited

U.S. PATENT DOCUMENTS 5,522,593 A * 6/1996 Kobayashi ..... A63B 53/04 473/349
5,595,552 A 1/1997 Wright et al.
(Continued)

FOREIGN PATENT DOCUMENTS

JP 2001-054599 A 2/2001
JP 2012-095855 A 5/2012

OTHER PUBLICATIONS

International Search Report issued in PCT/JP2013/078169 dated Nov. 12, 2013.

(Continued)

*Primary Examiner* — David P Bryant
*Assistant Examiner* — Nirvana Deonauth
(74) *Attorney, Agent, or Firm* — Birch, Stewart, Kolasch & Birch, LLP

(57) ABSTRACT

It is an object of the present invention to provide a golf club head being lightweight and having a high strength. A head 2 includes a face 4, a sole 8, and a crown 6. The face 4 includes a face surface fs and a face back surface fr. A plurality of projections (A) are provided on the face back surface fr. The projections (A) are point-like in a planar view. An optional first direction and a second direction orthogonal to the first direction are defined in the planar view. Preferably, arrangement regularity of the projections (A) in the second direction is higher than arrangement regularity of the projections (A) in the first direction. Preferably, the first direction is a longitudinal direction; and the second direction is a lateral direction.

12 Claims, 12 Drawing Sheets

(52) U.S. Cl.
CPC ..... *A63B 2053/0408* (2013.01); *A63B 2053/0416* (2013.01); *A63B 2053/0454* (2013.01); *A63B 2053/0458* (2013.01)

(56) References Cited

U.S. PATENT DOCUMENTS

| | | | | | |
|---|---|---|---|---|---|
| 5,601,501 | A | | 2/1997 | Kobayashi | |
| 5,676,605 | A | * | 10/1997 | Kobayashi | A63B 53/04 473/331 |
| 5,709,615 | A | | 1/1998 | Liang | |
| 5,735,755 | A | * | 4/1998 | Kobayashi | A63B 53/04 473/342 |
| D398,687 | S | | 9/1998 | Miyajima et al. | |
| 5,908,357 | A | | 6/1999 | Hsieh | |
| 6,299,548 | B1 | | 10/2001 | Lin | |
| 6,663,501 | B2 | | 12/2003 | Chen | |
| D518,538 | S | | 4/2006 | Ines et al. | |
| 8,070,623 | B2 | | 12/2011 | Stites et al. | |
| 2004/0082405 | A1 | | 4/2004 | Sano | |
| 2007/0254749 | A1 | | 11/2007 | Nakamura | |
| 2011/0159987 | A1 | | 6/2011 | Takechi et al. | |
| 2012/0064994 | A1 | | 3/2012 | Wada et al. | |
| 2012/0108359 | A1 | | 5/2012 | Abe | |
| 2013/0143690 | A1 | * | 6/2013 | Sakai | A63B 53/047 473/350 |

OTHER PUBLICATIONS

Written Opinion of the International Searching Authority issued in PCT/JP2013/078169 dated Nov. 12, 2013.

* cited by examiner

GOLF CLUB HEAD

CROSS-REFERENCE TO RELATED APPLICATIONS

The present application is a 37 C.F.R. § 1.53(b) divisional of U.S. application Ser. No. 14/436,371 filed Apr. 16, 2015, which is a 35 U.S.C. § 371 National Phase of PCT International Application No. PCT/JP2013/078169 filed Oct. 17, 2013, which claims priority on Japanese Patent Application No. 2012-229374 filed Oct. 17, 2012. The entire contents of each of these applications is hereby incorporated by reference.

TECHNICAL FIELD

The present invention relates to a golf club head.

BACKGROUND ART

In respect of an improvement in a degree of freedom of design, a golf head being more lightweight and having a high strength is required.

Japanese Patent Application Laid-Open No. 2012-95855 discloses a head having a face part with a thickness distribution. The face part includes a middle thick part, a toe-crown side thin-walled part provided on a crown side of the middle thick part on a toe side of the middle thick part and having a small thickness, and a heel-sole side thin-walled part provided on a sole side of the middle thick part on a heel side of the middle thick part and having a small thickness. In the head, rebound performance in an off center shot is improved by providing the thin-walled part on a peripheral part of a face.

CITATION LIST

Patent Literature

Patent Literature 1: JP-A-2012-95855

SUMMARY OF INVENTION

Technical Problem

It has been found that a structure different from the structure of the conventional technique can provide a face being lightweight and having a high strength. It is an object of the present invention to provide a golf club head being lightweight and having a high strength.

Solution to Problem

A golf club head of the present invention includes a face, a sole, and a crown. The face includes a face surface and a face back surface. A plurality of projections (A) are provided on the face back surface. The projections (A) are point-like in a planar view.

An optional first direction and a second direction orthogonal to the first direction are defined in the planar view. Preferably, arrangement regularity of the projections (A) in the second direction is higher than arrangement regularity of the projections (A) in the first direction.

Preferably, the first direction is a longitudinal direction; and the second direction is a lateral direction.

An area of each of the projections (A) in the planar view is defined as Ma. Preferably, the two or more kinds of projections (A) have areas Ma substantially different from each other.

Preferably, the projections (A) include a projection (A1) of which the area Ma is an area Ma1, a projection (A2) of which the area Ma is an area Ma2, and a projection (A3) of which the area Ma is an area Ma3. Preferably, the area Ma1 is greater than the area Ma2. Preferably, the area Ma2 is greater than the area Ma3. Preferably, the projection (A2) is disposed on a face peripheral side with respect to the projection (A1) in the first direction. Preferably, the projection (A3) is disposed on a face peripheral side with respect to the projection (A2) in the first direction.

A longitudinal distance between a periphery of the face back surface and the projection (A1) is defined as a1. A longitudinal distance between the periphery of the face back surface and the projection (A2) is defined as a2. A longitudinal distance between the periphery of the face back surface and the projection (A3) is defined as a3. An average value of the distances a1 is defined as Av1. An average value of the distances a2 is defined as Av2. An average value of the distances a3 is defined as Av3. Preferably, the average value Av1 is greater than the average value Av2. Preferably, the average value Av2 is greater than the average value Av3.

Preferably, an area Ma of each of the projections (A) is 3 $mm^2$ or greater and 40 $mm^2$ or less in the planar view. Preferably, a height Ha of each of the projections (A) is 0.03 mm or greater and 0.2 mm or less.

Preferably, a middle projection arrangement region including a face back surface center is present as one of the projection arrangement regions. Preferably, arrangement regularity in the second direction is higher than arrangement regularity in the first direction in the middle projection arrangement region.

Preferably, the head is manufactured by joining a face member and another member. Preferably, the face member is manufactured by forging. Preferably, the forging includes a preceding forging step and a subsequent forging step. Preferably, projections (B) higher than the projections (A) are formed on the face back surface in the preceding forging step. Preferably, the projections (A) are formed by crushing the projections (B) in the subsequent forging step.

Advantageous Effects of Invention

A golf club head being lightweight and having a high strength can be obtained.

DESCRIPTION OF EMBODIMENTS

The present invention will be described below in detail based on preferred embodiments with appropriate reference to the drawings.

Figure 1:
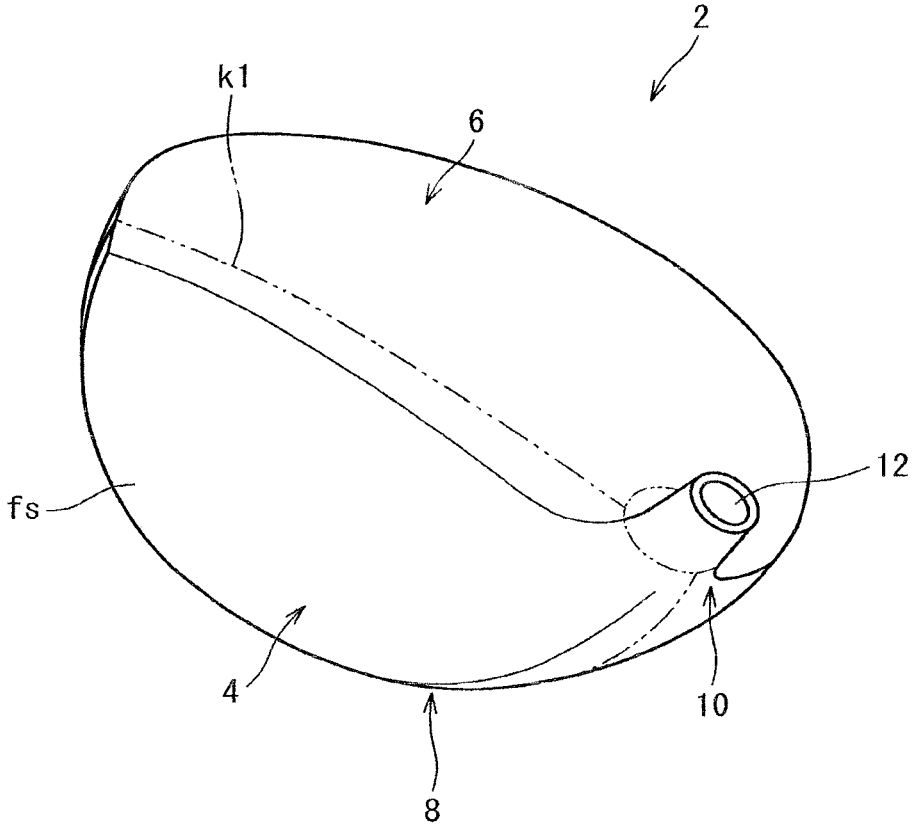
FIG. 1 is a perspective view of a golf club head according to a first embodiment of the present invention.

FIG. 1 is a perspective view of a golf club head 2 according to a first embodiment of the present invention.

The head 2 includes a face 4, a crown 6, a sole 8, and a hosel 10. The face 4 includes a face surface fs. The face surface fs is a hitting surface. The crown 6 extends toward the back of the head from the upper edge of the face 4. The sole 8 extends toward the back of the head from the lower edge of the face 4. The head 2 is hollow. The head 2 is a wood type golf club head.

Figure 2:
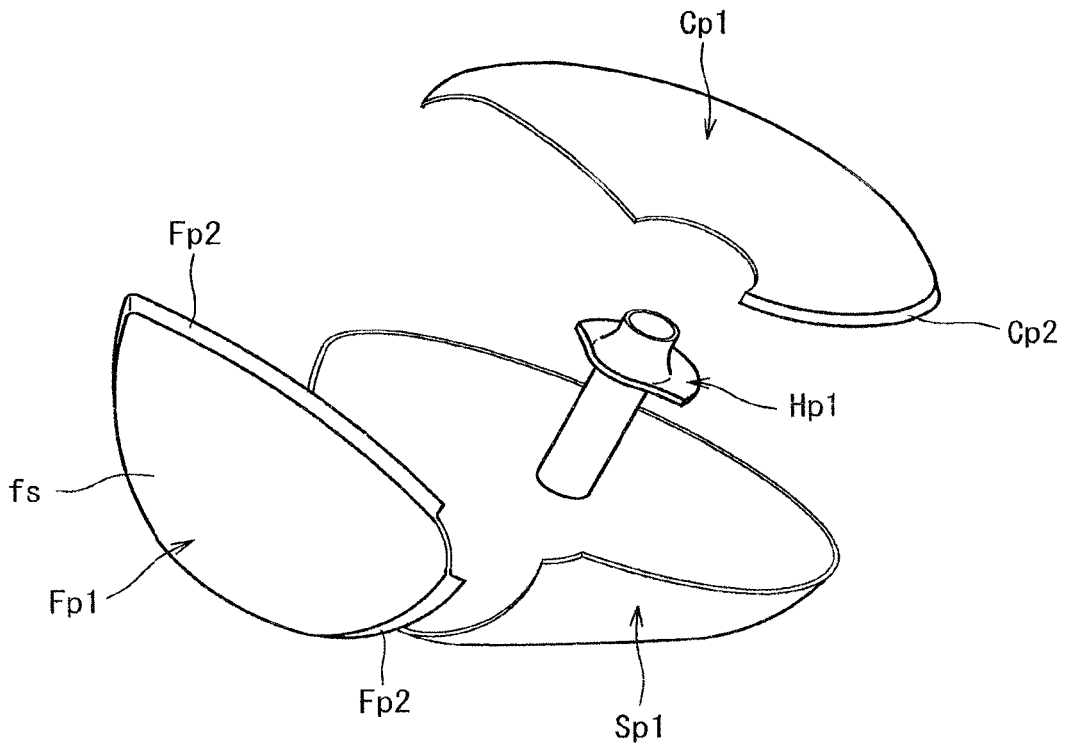
FIG. 2 is an exploded perspective view of the head of FIG. 1.

FIG. 2 is an exploded perspective view of the head 2. The head 2 has a four-piece structure. Members constituting the head 2 are a face member Fp1, a sole member Sp1, a crown member Cp1, and a hosel member Hp1. The head 2 is manufactured by welding these members.

Figure 3:
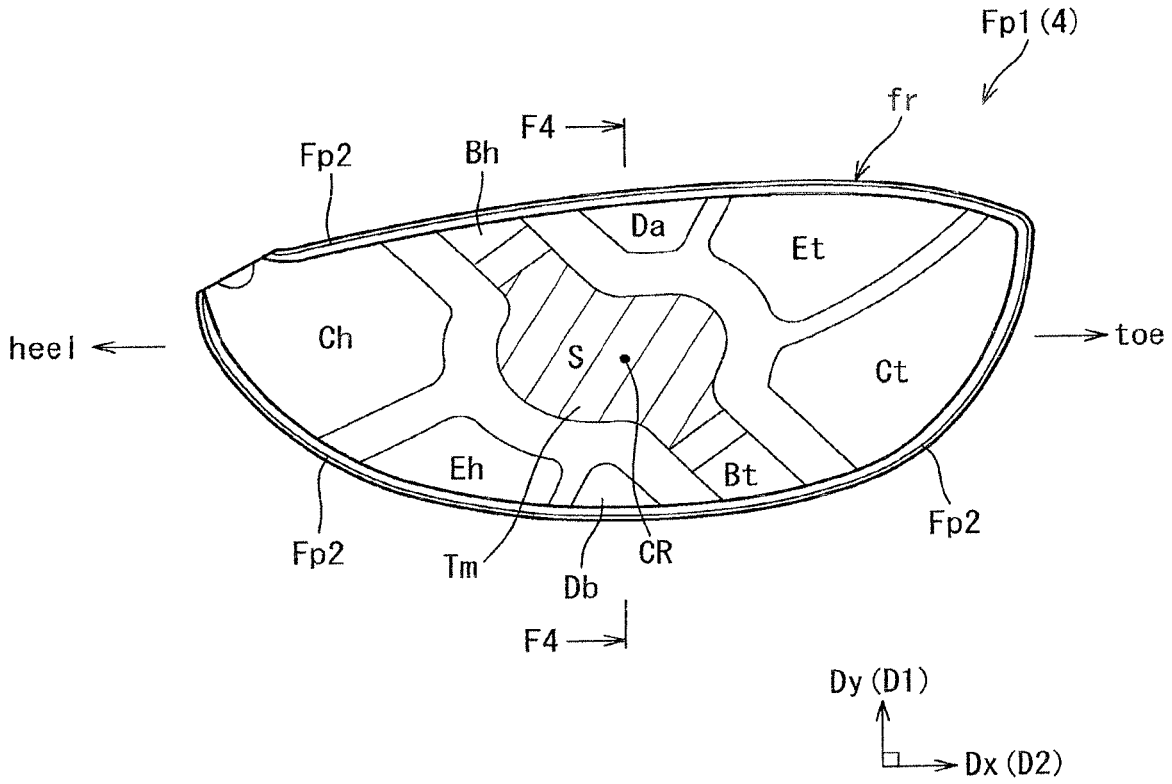
FIG. 3 is a plan view of a back surface of a face member, and projections (A) are omitted in FIG. 3.
Figure 4:
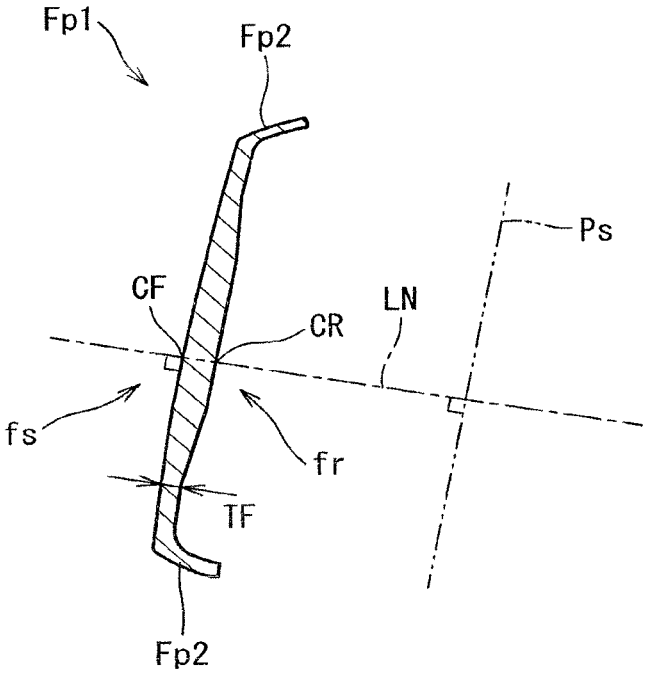
FIG. 4 is a cross-sectional view taken along line F4-F4 of FIG. 3.

FIG. 3 is a plan view showing a back surface fr of the face member Fp1. FIG. 4 is a cross-sectional view taken along line F4-F4 of FIG. 3. As described later, a plurality of projections (A) are formed on the back surface fr. However, these projections (A) are omitted in FIGS. 3 and 4.

The face member Fp1 constitutes the whole face 4. Furthermore, the face member Fp1 includes a backward extending part Fp2 (see FIG. 4). The backward extending part Fp2 constitutes a part of the crown 6. The backward extending part Fp2 constitutes a part of the sole 8. The face member Fp1 including the backward extending part Fp2 is also referred to as a cup face. A boundary k1 between the face member Fp1 and the other portion is shown by a two-dot chain line in FIG. 1. The boundary k1 is not visually recognized in the completed coated head 2.

The hosel 10 includes a shaft hole 12 to which a shaft is attached. The shaft which is not shown is inserted into the shaft hole 12. Although not shown in the figures, the shaft hole 12 has a center axis line Z1. The center axis line Z1 coincides with a shaft axis line of a golf club including the head 2.

In the present application, a base perpendicular plane, a face-back direction, and a toe-heel direction are defined. A state where the center axis line Z1 is included in a plane P1 perpendicular to a level surface H and the head 2 is placed at a predetermined lie angle and real loft angle on the level surface H is defined as a base state. The plane P1 is defined as a base perpendicular plane. The predetermined lie angle and real loft angle are described in, for example, a product catalog.

In the present application, the toe-heel direction is a direction of an intersection line between the base perpendicular plane and the level surface H.

In the present application, the face-back direction is a direction perpendicular to the toe-heel direction and parallel to the level surface H.

In the present application, a face center is defined. On the face surface, a maximum width Wx in the toe-heel direction is determined. Furthermore, a middle position Px of the maximum width Wx in the toe-heel direction is determined. At the position Px, a middle point Py of the face surface in an up-down direction is determined. The point Py is defined as the face center.

In the present application, an up-down direction is defined. The up-down direction is a direction perpendicular to the face-back direction and perpendicular to the toe-heel direction.

In the present application, a longitudinal direction Dy is defined (see FIG. 3). The longitudinal direction Dy is a direction of a projection straight line obtained by projecting a straight line drawn in the up-down direction onto a specific plane Ps (see FIG. 4). The specific plane Ps is a plane perpendicular to a straight line LN (described later).

In the present application, a lateral direction Dx is defined (see FIG. 3). The lateral direction Dx is a direction on the specific plane Ps, and perpendicular to the longitudinal direction Dy. The lateral direction Dx is equal to the toe-heel direction.

In the present application, a first direction D1 and a second direction D2 are defined. The first direction D1 and the second direction D2 are directions on the specific plane Ps. The first direction D1 may be any direction. The second direction D2 is orthogonal to the first direction D1. The longitudinal direction Dy is an example of the first direction D1. The lateral direction Dx is an example of the second direction D2.

In the present application, the disposition and areas of projections on the face back surface fr are estimated in a planar view. The planar view means a projection image Ps1 to the specific plane Ps.

In the projection to the specific plane Ps, the projection direction is a direction of a face normal line (described later).

In the present application, a face back surface center CR is defined. The straight line LN in FIG. 4 is a normal line of the face surface fs passing through a face center CF. An intersection point between the normal line LN and the face back surface fr is the face back surface center.

In the present application, the direction of the straight line LN is defined as the direction of the face normal line.

The face member Fp1 may be divided into a plurality of regions based on a face thickness TF. As shown in FIG. 3, in the face back surface fr, division lines are formed. These division lines can be recognized visually as ridge lines. In a cross-sectional view, the ridge line has a roundness. The whole face back surface fr smoothly continues. As shown in FIG. 3, the face back surface fr includes a region S, a region Bt, a region Bh, a region Ct, a region Ch, a region Da, a region Db, a region Et, and a region Eh. Regions other than these regions are transition regions having the thickness TF gradually changed.

The height of each of the projections (A) is not included in the face thickness TF.

In FIG. 3, hatching is applied to only the region S. Hatching is omitted in the other regions.

The region S is located in a middle part of the face 4. The region S includes a face center position. In other words, the region S includes the face back surface center.

The region Bt is located below the region S. The region Bt is located on a toe side with respect to the face center. The region Bt is located below the face center.

The region Bh is located above the region S. The region Bh is located on a heel side with respect to the face center. The region Bh is located above the face center.

The region Ct is located on a toe side with respect to the region S. The region Ct is located on a toe side with respect to the face center. The region Ct includes a face center up-down position. The face center up-down position is a position of the face center in the up-down direction.

The region Ch is located on a heel side with respect to the region S. The region Ch is located on a heel side with respect to the face center. The region Ch includes the face center up-down position.

The region Da is located above the region S. The region Da is located above the face center. The region Da includes a face center right-left position. The face center right-left position is a position of the face center in the toe-heel direction.

The region Db is located below the region S. The region Db is located below the face center. The region Db includes the face center right-left position.

The center of gravity of the region Et is located on a toe side with respect to the region S. The region Et is located on a toe side with respect to the face center. The region Et does not include the face center up-down position. The region Et does not include the face center right-left position. The center of gravity of the region Et is located above the center of gravity of the region Ct.

The center of gravity of the region Eh is located on a heel side with respect to the region S. The region Eh is located on a heel side with respect to the face center. The region Eh does not include the face center up-down position. The region Eh does not include the face center right-left position. The center of gravity of the region Eh is located below the center of gravity of the region Ch.

In the present embodiment, the thickness TF of each region is as follows.

region S: 3.3 mm or greater and 3.5 mm or less
region Bt: 2.5 mm or greater and 2.7 mm or less
region Bh: 2.5 mm or greater and 2.7 mm or less
region Ct: 2.4 mm or greater and 2.6 mm or less
region Ch: 2.4 mm or greater and 2.6 mm or less
region Da: 2.1 mm or greater and 2.3 mm or less
region Db: 2.1 mm or greater and 2.3 mm or less
region Et: 2.0 mm or greater and 2.2 mm or less
region Eh: 2.0 mm or greater and 2.2 mm or less These regions are common in all embodiments which will be described later.

The difference between the maximum value and the minimum value of the thickness TF in each region is preferably equal to or less than 0.15 mm, and more preferably equal to or less than 0.1 mm.

The region S is a maximum thickness region Tm. If the maximum value of the face thickness TF is defined as Tmax (mm), the maximum thickness region Tm means a region in which the face thickness TF is equal to or greater than [Tmax−0.2] mm. The face thickness TF is a thickness in the direction of the face normal line.

Figure 5:
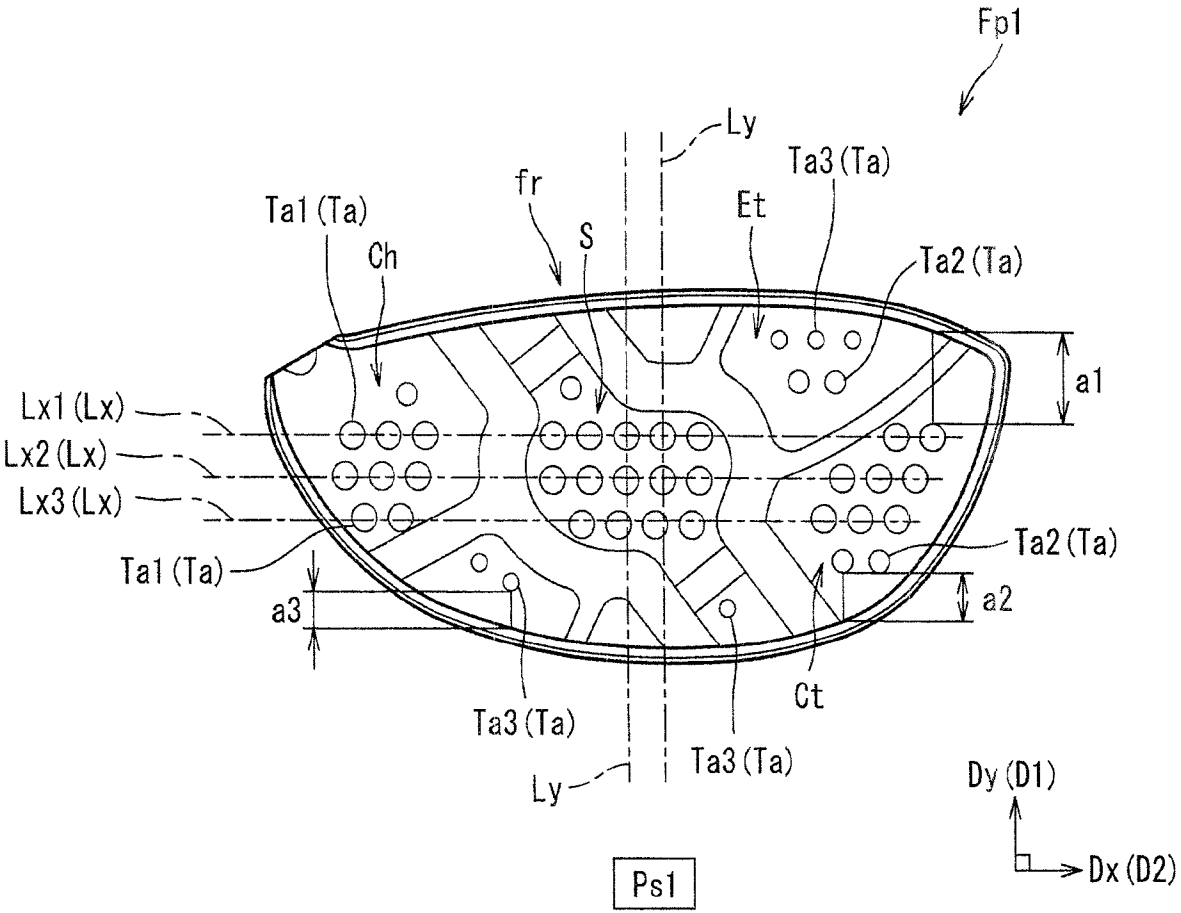
FIG. 5 is a plan view of the back surface of the face member.

The face back surface fr has at least a projection arrangement region. The projection arrangement region has two or more projections (A). In the embodiment of FIG. 5, the projection arrangement regions are the region S, the region Ct, the region Ch, the region Et, and the region Eh.

As shown in FIG. 5, a plurality of projections (A) are arranged on the face back surface fr. The plurality of projections (A) are arranged in each of the longitudinal direction Dy and the lateral direction Dx.

In the present application, an area of each of the projections (A) in the planar view is defined as Ma. The two or more kinds of projections (A) having the areas Ma substantially different from each other are provided on the face back surface fr. In the embodiment of FIG. 5, the three kinds of projections (A) having the areas Ma substantially different from each other are provided. The phrase "substantially different" means that the difference between the areas Ma is equal to or greater than 5%.

In the embodiment of FIG. 5, the three kinds of projections (A) include a projection (A1), a projection (A2), and a projection (A3). The area Ma of the projection (A1) is Ma1. The area Ma of the projection (A2) is Ma2. The area Ma of the projection (A3) is Ma3. The area Ma1, the area Ma2, and the area Ma3 are substantially different.

In the drawings of the present application, each of the projections (A) is shown by reference character Ta. In the drawings of the present application, the projection (A1) is shown by reference character Ta1. In the drawings of the present application, the projection (A2) is shown by reference character Ta2. In the drawings of the present application, the projection (A3) is shown by reference character Ta3.

Stress acting on the face is likely to be dispersed at random by providing the two or more kinds of projections (A) having the areas Ma substantially different from each other. The dispersion of the stress can relieve stress concentration to improve a face strength.

Figure 6:
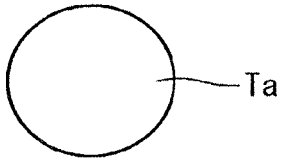
FIGS. 6(*a*), 6(*b*), and 6(*c*) are plan views showing the shapes of the projections (A)
Figure 6:
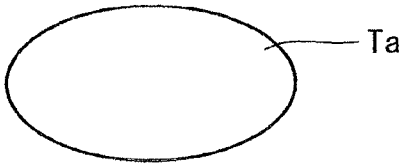
Figure 6:
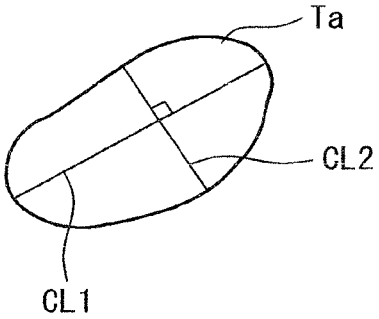

In the planar view, the projections (A) are point-like. FIGS. 6(*a*), 6(*b*), and 6(*c*) show examples of point-like projections Ta. FIG. 6(*a*) shows a circular projection Ta. In the embodiment of FIG. 5, all the projections Ta are circular. FIG. 6(*b*) shows an elliptical projection Ta. FIG. 6(*c*) shows an irregular projection Ta.

As shown in FIG. 6(*c*), a longest transversal line CL1 in an outline in the planar view is determined. Furthermore, a transversal line CL2 which is the longest among transversal lines perpendicular to the longest transversal line is determined. A length of the transversal line CL1 is defined as N1, and a length of the transversal line CL2 is defined as N2. In the case of the ellipse as shown in FIG. 6(*b*), the transversal line CL1 is a long axis, and the transversal line CL2 is a short axis. In the present application, the case where N1/N2 is equal to or less than 8 is defined to be point-like. In respect of improving the strength of the face 4 while suppressing the mass of the projection Ta, N1/N2 is preferably equal to or less than 5, more preferably equal to or less than 2, and still more preferably equal to or less than 1.5. N1/N2 is equal to or greater than 1. In the case of the circle, N1/N2 is 1.

Examples of the shape of the projection Ta in the planar view include a regular polygon as well as the above-mentioned circle and ellipse. Examples of the regular polygon include a square, a regular pentagon, and a regular hexagon. In respect of equally dispersing the stress acting on the face 4, the shape is preferably the circle.

[Effects of Projections (A)]

The projections (A) are point-like, and thereby the strength of the face can be improved without thickening the whole face. The plurality of projections (A) are dispersively disposed, and thereby the face strength can be improved in a wide range without thickening the whole face. The point-like projections (A) can be disposed at positions where an improvement in the strength is required, and thereby the degree of freedom of design of the face is improved. Therefore, a face 4 being lightweight and having a high strength can be obtained. The point-like projections (A) are suitable for obtaining a strength improvement effect (described later) caused by forging.

Figure 7:
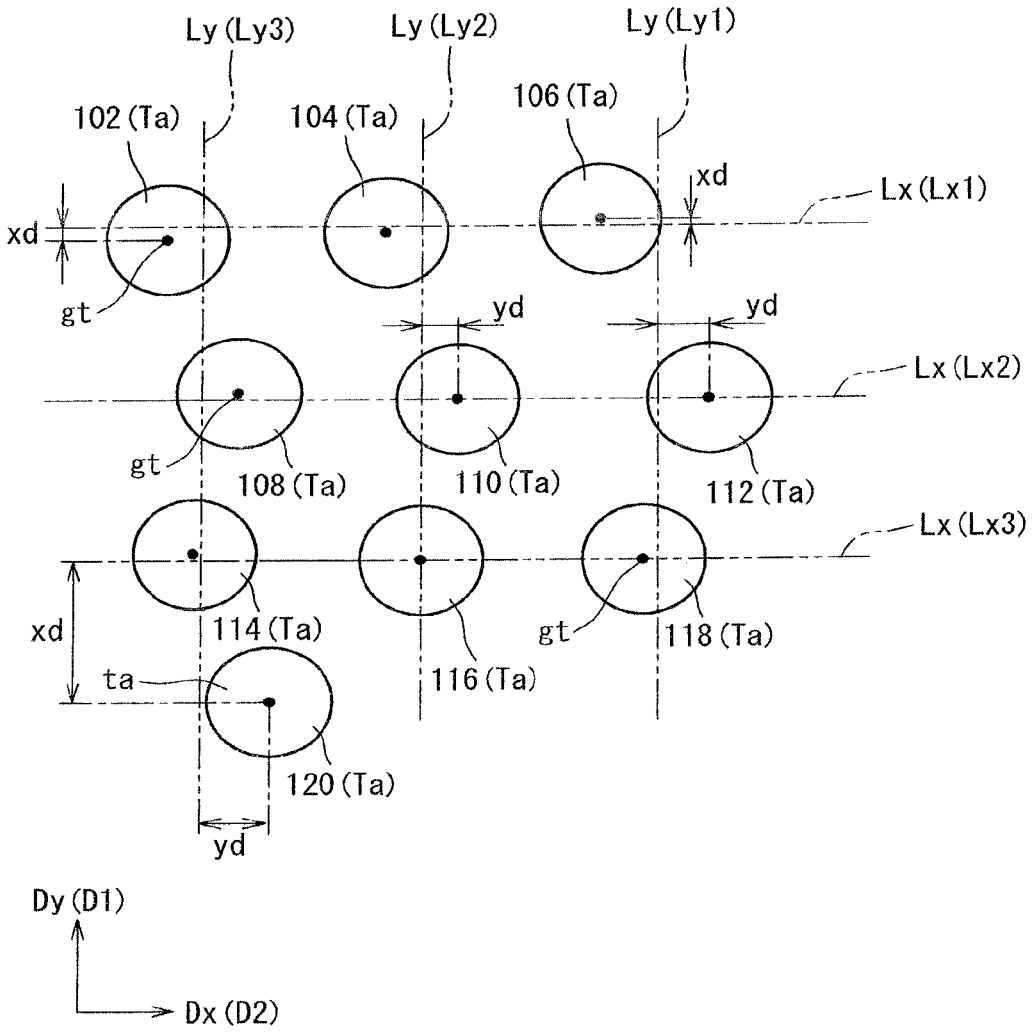
FIG. 7 is a plan view for describing arrangement regularity.

In the present application, the arrangement regularity of the projections (A) is defined. FIG. 7 is a view for describing the arrangement regularity. Herein, the case where the first direction D1 is the longitudinal direction Dy and the second direction D2 is the lateral direction Dx is described. The arrangement regularity is estimated in the planar view.

In order to determine the arrangement regularity, a lateral direction line Lx and a longitudinal direction line Ly are considered. The lateral direction line Lx is a straight line extending in the lateral direction Dx. The longitudinal direction line Ly is a straight line extending in the longitudinal direction Dy. In FIG. 7, a lateral direction line Lx1, a lateral direction line Lx2, and a lateral direction line Lx3 are determined as the lateral direction line Lx. In FIG. 7, a longitudinal direction line Ly1, a longitudinal direction line Ly2, and a longitudinal direction line Ly3 are determined as the longitudinal direction line Ly.

In the embodiment of FIG. 7, ten projections Ta are disposed. That is, a projection 102, a projection 104, a projection 106, a projection 108, a projection 110, a projection 112, a projection 114, a projection 116, a projection 118, and a projection 120 are disposed.

The projection 102, the projection 104, and the projection 106 intersect with a first lateral direction line Lx1. The projection 108, the projection 110, and the projection 112 intersect a second lateral direction line Lx2. The projection 114, the projection 116, and the projection 118 intersect with a third lateral direction line Lx3.

The projection 106, the projection 112, and the projection 118 intersect with a first longitudinal direction line Ly1. The projection 104, the projection 110, and the projection 116 intersect with a first longitudinal direction line Ly2. The projection 102, the projection 108, and the projection 114 intersect with a third longitudinal direction line Ly3.

A center of figure of the projection Ta is shown by reference character gt in FIG. 7. A distance between the center of figure gt of the projection Ta and the lateral direction line Lx is shown by a double-headed arrow xd in FIG. 7. The lateral direction line Lx intersects with the two or more projections Ta. The number of the lateral direction line Lx which intersects with one projection Ta is one. In the embodiment of FIG. 7, each of the three lateral direction lines Lx intersects with the three projections Ta.

The projection Ta intersecting with the lateral direction line Lx is a measurement target for the distance xd. However, the projection Ta which does not intersect with the lateral direction line Lx may also be assumed. As shown in FIG. 7, the projection 120 which does not intersect with the lateral direction line Lx is also a measurement target for the distance xd. The distance xd is measured between the center of figure gt of the projection Ta and the lateral direction line Lx closest to the center of figure gt.

A distance between the center of figure gt of the projection Ta and the longitudinal direction line Ly is shown by a double-headed arrow yd in FIG. 7. The longitudinal direction line Ly intersects with two or more projections Ta. The number of the longitudinal direction line Ly which intersects with one projection Ta is one. In the embodiment of FIG. 7, each of the three longitudinal direction lines Ly intersects with three projections Ta.

The projection Ta intersecting with the longitudinal direction line Ly is a measurement target for the distance yd. Furthermore, as shown in FIG. 7, the projection 120 which does not intersect with the longitudinal direction line Ly is also a measurement target for the distance yd. The distance yd is measured between the center of figure gt of the projection Ta and the longitudinal direction line Ly (Ly3) closest to the center of figure gt.

As many lateral direction lines Lx and longitudinal direction lines Ly satisfying the above-mentioned condition as possible are determined. An average value Xv1 of the distances xd and an average value Yv1 of the distances yd are calculated. If a plurality of average values Xv1 can be calculated, the minimum value of the average values Xv1 is employed. If a plurality of average values Yv1 can be calculated, the minimum value of the average values Yv1 is employed.

If Xv1 is smaller than Yv1, the difference of the following arrangement regularity is realized.

[Difference of Arrangement Regularity]: The arrangement regularity of the projections (A) in the lateral direction Dx is higher than the arrangement regularity of the projections (A) in the longitudinal direction Dy.

Also if at least one lateral direction line Lx is present, and the longitudinal direction line Ly is not present, the difference of the arrangement regularity is realized.

The difference of the arrangement regularity causes a projection arrangement effect.

[Projection Arrangement Effect]

In order to describe the effect, a deformation in the toe-heel direction and a deformation in the up-down direction are defined. The deformation in the toe-heel direction in the present application means a deformation in which the fold by the deformation is generated in the up-down direction. Meanwhile, the deformation in the up-down direction in the present application means a deformation in which the fold by a deformation is generated in the toe-heel direction.

The deformation in which the fold is generated in the up-down direction is less likely to occur by decreasing the arrangement regularity in the longitudinal direction Dy. That is, the deformation in the toe-heel direction is less likely to occur by decreasing the arrangement regularity in the longitudinal direction Dy.

The length of the face in the toe-heel direction is greater than the length of the face in the up-down direction. For this reason, the deformation in the toe-heel direction is likely to be greater than the deformation in the up-down direction. The deformation in the toe-heel direction can be effectively suppressed by decreasing the arrangement regularity in the longitudinal direction Dy. The face strength can be improved by suppressing the excessive deformation.

Meanwhile, the deformation in the up-down direction is not excessively suppressed by increasing the arrangement regularity in the lateral direction Dx. Therefore, the deterioration in rebound performance can be suppressed. Balance between the deformation in the toe-heel direction and the deformation in the up-down direction is favorable, and thereby the face strength can be optimized.

Selective suppression of a deformation in a predetermined direction may be desired due to variation in hitting points, and design of a face thickness, or the like. In this case, the direction in which the suppression of the deformation is desired can be set to the second direction. The arrangement regularity of the projections (A) in the second direction is set to be higher than the arrangement regularity of the projections (A) in the first direction. The deformation in the second direction can be effectively suppressed by the arrangement.

In the embodiment of FIG. 5, the number of the projections Ta (projections Ta1) intersecting with the first lateral direction line Lx1 is X1. In the embodiment of FIG. 5, X1 is 10. In respect of improving the projection arrangement effect, X1 is preferably equal to or greater than 5, more preferably equal to or greater than 6, and still more preferably equal to or greater than 7. In respect of suppressing the weight of the face 4, X1 is preferably equal to or less than 15, more preferably equal to or less than 14, and still more preferably equal to or less than 13.

In the embodiment of FIG. 5, the number of the projections Ta (projections Ta1) intersecting with the second lateral direction line Lx2 is X2. In the embodiment of FIG. 5, X2 is 11. In respect of improving the projection arrangement effect, X2 is preferably equal to or greater than 5, more preferably equal to or greater than 6, and still more preferably equal to or greater than 7. In respect of suppressing the weight of the face 4, X2 is preferably equal to or less than 15, more preferably equal to or less than 14, and still more preferably equal to or less than 13.

In the embodiment of FIG. 5, the number of the projections Ta (projections Ta1) intersecting with the third lateral direction line Lx3 is X3. In the embodiment of FIG. 5, X3 is 9. In respect of improving the projection arrangement effect, X3 is preferably equal to or greater than 5, more preferably equal to or greater than 6, and still more preferably equal to or greater than 7. In respect of suppressing the weight of the face 4, X3 is preferably equal to or less than 15, more preferably equal to or less than 14, and still more preferably equal to or less than 13.

In the embodiment of FIG. 5, the arrangement regularity in the lateral direction Dx is higher than the arrangement regularity in the longitudinal direction Dy in the whole face back surface fr.

In the embodiment of FIG. 5, the arrangement regularity in the lateral direction Dx is higher than the arrangement regularity in the longitudinal direction Dy in the projection arrangement region S. The projection arrangement region S is a middle projection arrangement region S including the face back surface center CR. Large stress acts on the middle projection arrangement region S when a ball is hit. A portion on which the large stress acts can be selectively and effectively reinforced by applying the projection arrangement effect to the region S.

In the embodiment of FIG. 5, the arrangement regularity in the lateral direction Dx is higher than the arrangement regularity in the longitudinal direction Dy in the projection arrangement region Ct. The region Ct is a toe side projection arrangement region located on a toe side with respect to the region S.

In the embodiment of FIG. 5, the arrangement regularity in the lateral direction Dx is higher than the arrangement regularity in the longitudinal direction Dy in the projection arrangement region Ch. The region Ch is a heel side projection arrangement region located on a heel side with respect to the region S.

In the embodiment of FIG. 5, the arrangement regularity in the lateral direction Dx is higher than the arrangement regularity in the longitudinal direction Dy in the projection arrangement region Et.

In at least one projection arrangement region, the difference of the arrangement regularity can be applied. The projection arrangement effect can be applied to a desired projection arrangement region according to the application. Therefore, a region requiring a strength can be selectively reinforced.

As shown in FIG. 5, in the longitudinal direction Dy (first direction D1), the projection Ta2 is disposed on a face peripheral side with respect to the projection Ta1. The projection Ta3 is disposed on a face peripheral side with respect to the projection Ta2. The position of the projection Ta is estimated based on the center of figure gt.

A longitudinal distance between the periphery of the face back surface fr and the projection Ta1 is defined as a1. A longitudinal distance between the periphery of the face back surface fr and the projection Ta2 is defined as a2. A longitudinal distance between the periphery of the face back surface fr and the projection Ta3 is defined as a3. The longitudinal distance for each of the projections Ta is measured.

The average value of the distances a1 is defined as Av1. The average value of the distances a2 is defined as Av2. The average value of the distances a3 is defined as Av3. The average value Av1 is greater than the average value Av2. The average value Av2 is greater than the average value Av3.

The stress acting on the face 4 is comparatively large in the middle part of the face 4. The stress acting on the face 4 is comparatively small in the peripheral part of the face 4. In light of this point, the projection Ta of which the area Ma is comparatively small is disposed in the peripheral part of the face 4, and the projection Ta of which the area Ma is comparatively large is disposed in the middle part of the face 4. For this reason, the improvement in the face strength is achieved while the total volume of the projections (A) is suppressed.

Preferably, the area Ma of the projection (A) (projection Ta) is 3 $mm^2$ or greater and 40 $mm^2$ or less. In this range, the strength of the face 4 can be effectively improved while the increase in the mass of the face 4 is suppressed.

Preferably, the area Ma1 of the projection (A1) (projection Ta1) is 12 $mm^2$ or greater and 40 $mm^2$ or less. In this range, the strength of the face 4 can be effectively improved while the increase in the mass of the face 4 is suppressed. The projection (A) having the area Ma different from the area Ma1 can be easily provided by limiting the area Ma1 to the range.

Preferably, the area Ma2 of the projection (A2) (projection Ta2) is 6 $mm^2$ or greater and 30 $mm^2$ or less. In this range, the strength of the face 4 can be effectively improved while the increase in the mass of face 4 is suppressed. The projection (A) having the area Ma different from the area Ma2 can be easily provided by limiting the area Ma2 to the range.

Preferably, the area Ma3 of the projection (A3) (projection Ta3) is 3 $mm^2$ or greater and 20 $mm^2$ or less. In this range, the strength of the face 4 can be effectively improved while the increase in the mass of face 4 is suppressed. The projection (A) having the area Ma different from the area Ma3 can be easily provided by limiting the area Ma3 to the range.

In respect of improving an effect caused by the presence of the projection Ta, the height Ha of the projection (A) is preferably equal to or greater than 0.03 mm, more preferably equal to or greater than 0.05 mm, and still more preferably equal to or greater than 0.07 mm. In respect of reducing the mass of the face 4, the height Ha is preferably equal to or less than 0.2 mm, more preferably equal to or less than 0.17 mm, and still more preferably equal to or less than 0.15 mm.

Figure 8:
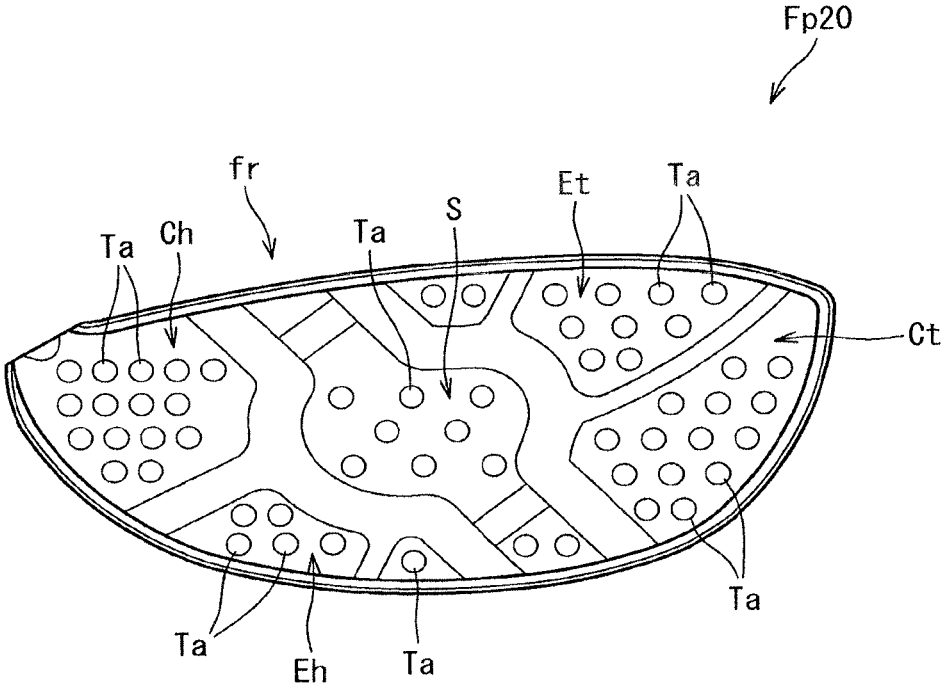
FIG. 8 is a plan view of a face back surface according to a second embodiment.

FIG. 8 is a plan view showing a face back surface fr of a face member Fp20 according to a second embodiment. The plan view shows the above-mentioned projection image Ps1. Except for the projections Ta, the face member Fp20 is the same as the face member Fp1.

A projection occupation ratio Rs is considered in the face member Fp20. The ratio Rs of the middle projection arrangement region S is smaller than the ratio Rs of the other region. The ratio Rs of the region S is smaller than the ratio Rs of the region Et. The ratio Rs of the region S is smaller than the ratio Rs of the region Ct. The ratio Rs of the region S is smaller than the ratio Rs of the region Eh. The ratio Rs of the region S is smaller than the ratio Rs of the region Ch. The ratio Rs is a ratio of the total area of the projections (A) to the area of the entire region. The ratio Rs is determined in the planar view.

In the face, the projection occupation ratio Rs of a face middle part is decreased, and the projection occupation ratio Rs of a face peripheral part is increased. Since the hardness of the peripheral part is further improved, the thickness of the peripheral part can be decreased. Therefore, the whole face 4 is likely to bend, which can provide the enlargement of a sweet area.

Figure 9:
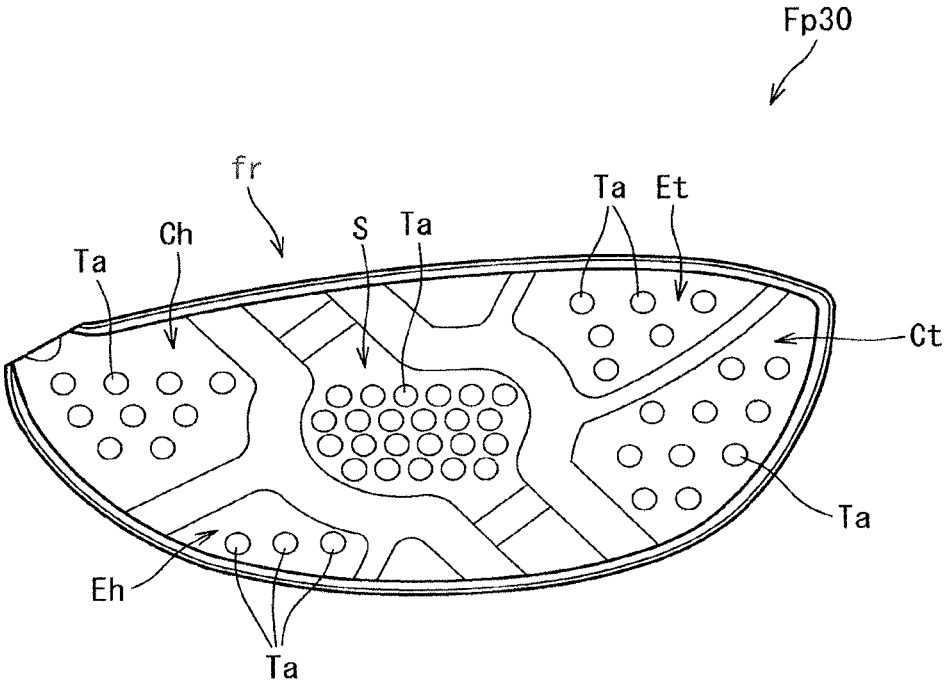
FIG. 9 is a plan view of a face back surface according to a third embodiment.

FIG. 9 is a plan view showing a face back surface fr of a face member Fp30 according to a third embodiment. The plan view shows the above-mentioned projection image Ps1. Except for projections Ta, the face member Fp30 is the same as the face member Fp1.

In the face member Fp30, the projection occupation ratio Rs of a middle projection arrangement region S is greater than the ratios Rs of the other regions. The ratio Rs of the region S is greater than the ratio Rs of the region Et. The ratio Rs of the region S is greater than the ratio Rs of the region Ct. The ratio Rs of the region S is greater than the ratio Rs of the region Eh. The ratio Rs of the region S is greater than the ratio Rs of the region Ch.

In the face, the projection occupation ratio Rs of a face middle part is increased. Since the hardness of the middle part is further improved, the thickness of the middle part can be decreased. Therefore, the bending of the face 4 when a ball is hit with the middle part is increased. For this reason, rebound performance when the ball is hit with the face middle part is improved, which can provide an increase in the maximum value of a coefficient of restitution. A maximum flight distance can be increased by the increase.

Figure 10:
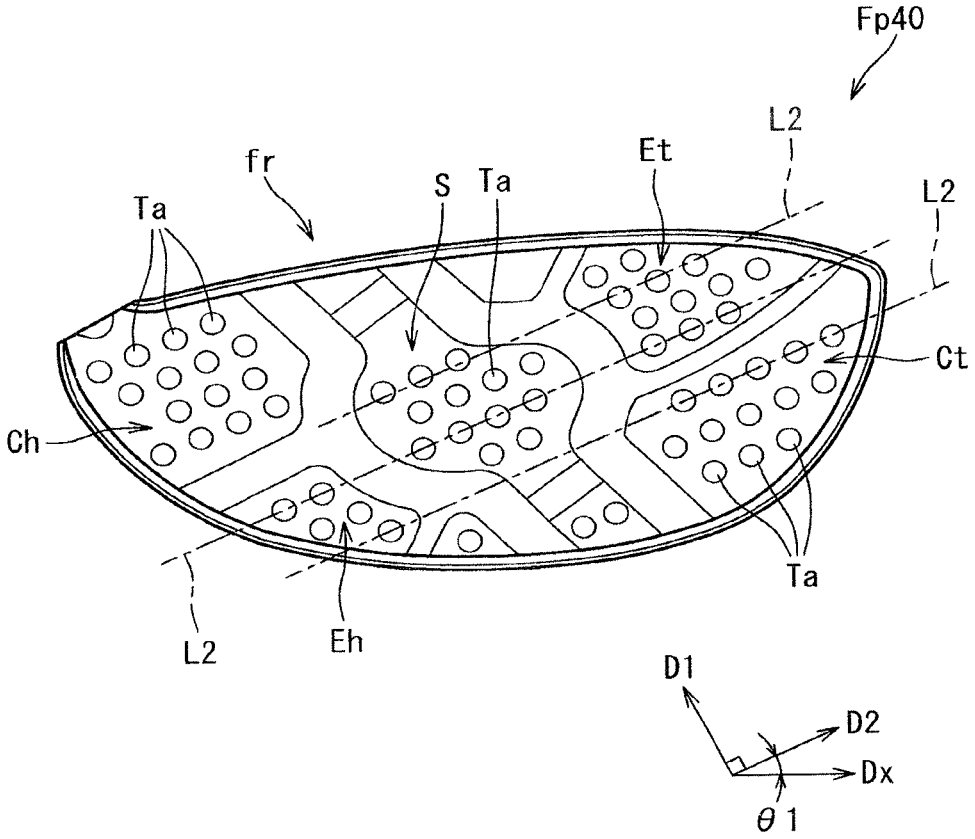
FIG. 10 is a plan view of a face back surface according to a fourth embodiment.

FIG. 10 is a plan view showing a face back surface fr of a face member Fp40 according to a fourth embodiment. The plan view shows the above-mentioned projection image Ps1. Except for the projections Ta, the face member Fp40 is the same as the face member Fp1.

In the embodiment of FIG. 10, the arrangement regularity of the projections (A) in a second direction D2 is higher than the arrangement regularity of the projections (A) in a first direction D1. The second direction D2 is inclined so as to be an upper side toward a toe side. An angle between a lateral direction Dx and the second direction D2 is shown by a double-headed arrow θ1 in FIG. 10.

Usually, a golfer has variation in hitting points. The golfer's hitting points tend to be distributed between the upper side of a toe and the lower side of a heel. The arrangement of the projections (A) is adapted for the distribution of the hitting points by inclining the second direction D2 with respect to the lateral direction Dx. For this reason, the projection arrangement effect can be further improved. In light of the distribution of the hitting points, the lower limit of the angle θ1 is preferably equal to or greater than 10 degrees, and more preferably equal to or greater than 15 degrees. The upper limit of the angle θ1 is preferably equal to or less than 50 degrees, and more preferably equal to or less than 45 degrees.

Figure 11:
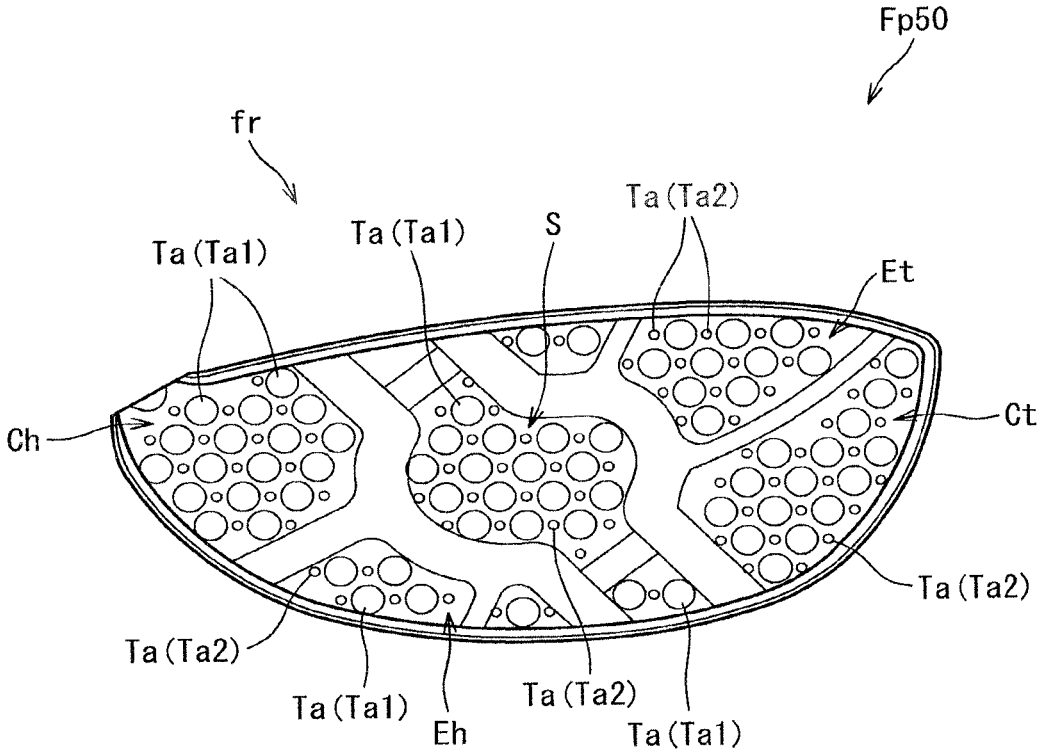
FIG. 11 is a plan view of a face back surface according to a fifth embodiment.

FIG. 11 is a plan view showing a face back surface fr of a face member Fp50 according to a fifth embodiment. The plan view shows the above-mentioned projection image Ps1. Except for the projections Ta, the face member Fp50 is the same as the face member Fp1.

In the embodiment of FIG. 11, a projection Ta2 is disposed between projections Ta1. The area Ma2 of the projection Ta2 is smaller than the area Ma1 of the projection Ta1. The projection occupation ratio Rs is effectively improved by the disposition. In respect of improving the projection occupation ratio Rs, Ma2/Ma1 is preferably equal to or less than 0.3, and more preferably equal to or less than 0.2. In respect of preventing Ma2 from being too small, Ma2/Ma1 is preferably equal to or greater than 0.02, and more preferably equal to or greater than 0.05.

Figure 12:
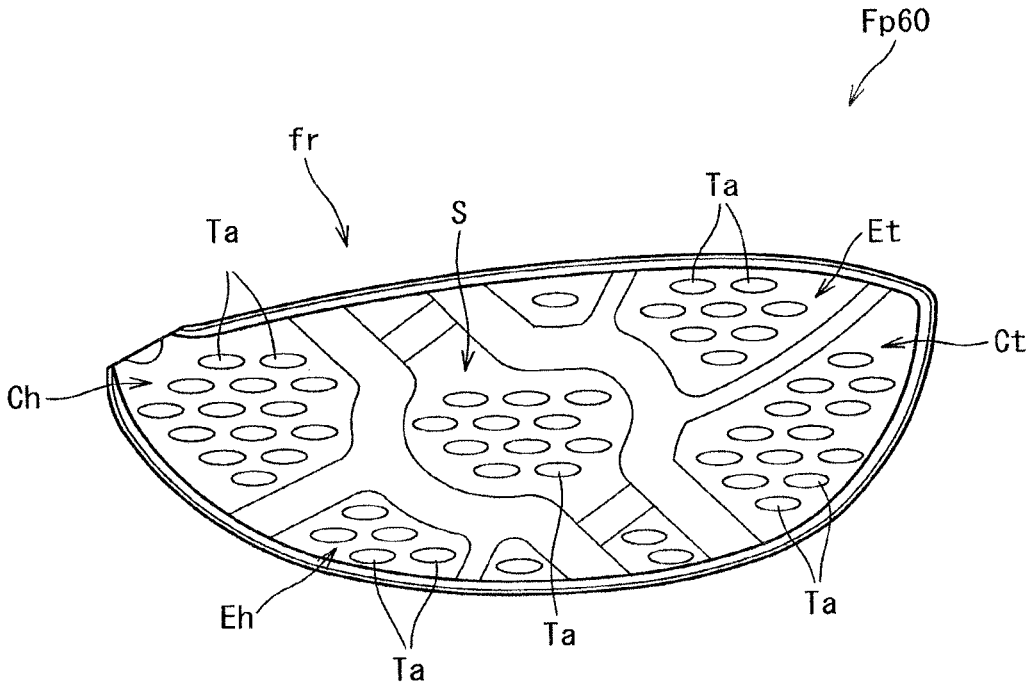
FIG. 12 is a plan view of a face back surface according to a sixth embodiment.

FIG. 12 is a plan view showing a face back surface fr of a face member Fp60 according to a sixth embodiment. The plan view shows the above-mentioned projection image Ps1. Except for the projections Ta, the face member Fp60 is the same as the face member Fp1.

In the embodiment of FIG. 12, the projection Ta has an ellipse shape. The long axis of the ellipse is substantially parallel to a lateral direction Dx. In other words, the absolute value of an angle between the long axis of the ellipse and the lateral direction Dx is equal to or less than 10 degrees. The projection Ta may not have the ellipse shape, and may have a shape shown in FIG. 6(*c*), for example. The absolute value of an angle between the longest transversal line CL1 and the lateral direction Dx is preferably equal to or less than 10 degrees. The projection arrangement effect can be further improved by the constitution.

The volume of the head is not limited. The present invention is effective when a face area is large. In this respect, the volume of the head is preferably equal to or greater than 400 cc, more preferably equal to or greater than 420 cc, and still more preferably equal to or greater than 440 cc. In respect of observing the rules for the golf club, the volume of the head is preferably equal to or less than 470 cc, and more preferably equal to or less than 460 cc.

The weight of the head is not limited. In respect of a swing balance, the weight of the head is preferably equal to or greater than 175 g, more preferably equal to or greater than 180 g, and still more preferably equal to or greater than 185 g. In respect of the swing balance, the weight of the head is preferably equal to or less than 205 g, more preferably equal to or less than 200 g, and still more preferably equal to or less than 195 g.

A method for manufacturing the head is not limited. Usually, a hollow head is manufactured by joining two or more members. A method for manufacturing the members constituting the head is not limited. Examples of the method include casting, forging, and press forming.

A method for manufacturing the face member Fp is not limited. Examples of the method include casting, forging, and press forming. However, the forging is preferable as described later. A method for forming the projections (A) is not limited. The projections (A) may be formed simultaneously with the formation of the face member Fp, and process for forming the projections (A) may be performed after the formation of the face member Fp. Examples of the process include cutting by NC process, and chemical milling. As described later, the projections (A) are preferably formed by forging the face member Fp.

The structure of the head is not limited. Examples of the structure of the head include a two-piece structure in which two members each integrally formed are joined, a three-piece structure in which three members each integrally formed are joined, and a four-piece structure in which four members each integrally formed are joined. The head 2 has the four-piece structure.

[Manufacture of Face Member Fp1]

Preferably, the face member Fp1 is manufactured by forging. If the projection (B) is crushed to form the projection (A), the forging number of the face member Fp1 is multiple. For example, the forging number is 2 or greater and 4 or less. In respect of productivity, the forging number is preferably 2 or 3, and more preferably 2.

Generally, the first forging is also referred to as rough forging. Generally, the last forging is also referred to as main forging.

A plurality of forgings include a preceding forging step and a subsequent forging step. The subsequent forging step is performed after the preceding forging step. If the forging number is 2, the first forging is the preceding forging step, and the second forging is the subsequent forging step. If the forging number is equal to or greater than 3, it is preferable that the last forging is the subsequent forging step and the forging immediately prior to the last forging is the preceding forging step.

The forging may be cold forging or hot forging. In respect of the improvement in the strength caused by the densification of the structure, the hot forging is preferable.

In the manufacture of the face member Fp1, in the preceding forging step, the approximate shape of the face member Fp1 is formed, and the projection (B) is formed. The projection (B) is higher than the projection (A). The projection (B) is crushed in the subsequent forging step. The crushed projection (B) constitutes the projection (A).

The projection (B) is crushed to form the projection (A), and thereby distortion is generated in metal crystal grains to produce recrystallization. The metal structure is densified by the recrystallization. The distortion can be generated by the crushing, to cause work hardening. The projection (B) is crushed to form the projection (A), and thereby the strength of the face member Fp1 can be improved.

Although the projection (B) is crushed, the projection (B) is not completely crushed, and the projection (A) remains. Therefore, an effect caused by the crushing is obtained. At the same time, the formation of the projection (A) is also achieved.

The height of the projection (B) is defined as Hb. The height of the projection (A) is defined as Ha. In respect of increasing the deformation amount of the projection (B) to improve the strength of the face member Fp1, Hb/Ha is preferably equal to or greater than 1.5, more preferably equal to or greater than 2, and still more preferably equal to or greater than 3. In respect of suppressing excessive crushing deformation, Hb/Ha is preferably equal to or less than 15, more preferably equal to or less than 12, and still more preferably equal to or less than 10.

In respect of obtaining moderate crushing deformation, the lower limit of the height Hb is preferably equal to or greater than 0.2 mm, and more preferably equal to or greater than 0.3 mm. The upper limit of the height Hb is preferably equal to or less than 1.5 mm, and more preferably equal to or less than 1.2 mm.

The area of the projection (B) in the planar view is defined as My. The area My is smaller than the area Ma. The area Ma of the projection (A) is made to be greater than the area My by the crushing. In respect of increasing the deformation amount of the projection (B) to improve the strength of the face member Fp1, Ma/My is preferably equal to or greater than 1.2, more preferably equal to or greater than 1.5, and still more preferably equal to or greater than 2. In respect of suppressing excessive crushing deformation, Ma/My is preferably equal to or less than 20, more preferably equal to or less than 15, and still more preferably equal to or less than 12.

In respect of obtaining moderate crushing deformation, the following items (a) and/or (b) are/is preferable:

(a) the area My of the projection (B) for forming the projection (A) is greater as the area Ma of the projection (A) is larger; and (b) the height Hb of the projection (B) for forming the projection (A) is greater as the area Ma of the projection (A) is larger.

EXAMPLE

Hereinafter, the effects of the present invention will be clarified by Example. However, the present invention should not be interpreted in a limited way based on the description of the Example.

Example

A face member Fp1, a sole member Sp1, a crown member Cp1, and a hosel member Hp1 as shown in FIG. 2 were obtained by forging. A titanium alloy was used as a material for all the members. The material of the face member Fp1 was "Super-TIX 51AF" (trade name) manufactured by NIPPON STEEL & SUMITOMO METAL CORPORATION.

The forging number of the face member Fp1 was set to 2. The face member Fp1 was manufactured by a preceding forging step and a subsequent forging step. Both the preceding forging step and the subsequent forging step were hot forging. A round bar as a material was subjected to the preceding forging step in a state where the round bar was set in a preceding forging mold. A preceding forged molded body was obtained in the preceding forging step. The outer shape of the preceding forged molded body was substantially the same as the outer shape of the face member Fp1 as a last molded body. The preceding forged molded body had projections (B). The positions and number of the projections (B) were made the same as the positions and number of the projections (A) shown in FIG. 5.

The projections (B) included a projection (B1) of which the height Hb was Hb1, a projection (B2) of which the height Hb was Hb2, and a projection (B3) of which the height Hb was Hb3. The height Hb1 was greater than the height Hb2. The height Hb2 was greater than the height Hb3. The height Hb1 was set to 1 mm. The height Hb2 was set to 0.4 mm. The height Hb3 was set to 0.3 mm.

The preceding forged molded body was subjected to the subsequent forging step in a state where the preceding forged molded body was set in a subsequent forging mold. A subsequent forged molded body (face member Fp1 shown in FIG. 5) was obtained in the subsequent forging step. The subsequent forged molded body had a projection (A1), a projection (A2), and a projection (A3).

The projection (B1) was crushed to form the projection (A1). The projection (B2) was crushed to form the projection (A2). The projection (B3) was crushed to form the projection (A3).

The area Ma1 of the projection (A1) was 15 $mm^2$. The height Ha1 of the projection (A1) was 0.1 mm. The area Ma2 of the projection (A2) was 12 $mm^2$. The height Ha2 of the projection (A2) was 0.1 mm. The area Ma3 of the projection (A3) was 9 $mm^2$. The height Ha3 of the projection (A3) was 0.1 mm.

The face member Fp1 and the other members were welded to obtain a head of Example as shown in FIG. 1. A 46-inch golf club was produced by using the head.

Comparative Example

A face member having no projection (A) was produced by changing a forging mold. In the face member, a face thickness was added as compared with Example. The face thickness was added to each of regions shown in FIG. 3. The additional thickness was made the same as the height of the projection (A) which was present in each of the regions. A head and a golf club of Comparative Example were obtained in the same manner as in Example except for the constitution.

Although Comparative Example had no projection (A), manufacturing conditions in Comparative Example were made the same as manufacturing conditions in Example. Forging conditions such as the forging number in Comparative Example were also made the same as forging conditions in Example.

[Evaluation of Strength]

A swing robot was equipped with a golf club, and repeatedly hit a commercially available two-piece ball at a head speed of 54 m/s. A hitting point was set to a face center. It was visually confirmed whether cracks were generated on a face surface for every 100 hits.

In Example, the hitting number when the cracks were confirmed was 10400. In Comparative Example, the hitting number when the cracks were confirmed was 10500. Although the face of Example was more lightweight than the face of Comparative Example, the face strength of Example was equivalent to the face strength of Comparative Example.

INDUSTRIAL APPLICABILITY

The present invention can be applied to all golf club heads such as a wood type head, a utility type head, a hybrid type head, and an iron type head.

REFERENCE SIGNS LIST

2 Head
4 Face
6 Crown
8 Sole
10 Hosel
12 Shaft hole
fs Face surface
fr Face back surface
Fp1, Fp20, Fp30, Fp40, Fp50, Fp60 Face members
Cp1 Crown member
Sp1 Sole member
Hp1 Hosel member
Ta Projection (A)
Ta1 Projection (A1)
Ta2 Projection (A2)
Ta3 Projection (A3)

The invention claimed is:

1. A manufacturing method of a golf club head comprising the steps of:

forging a face member, the face member including a face surface that is a hitting surface and a face back surface that is located opposite the face surface; and joining the face member and another member, wherein the step of forging includes:

a preceding forging step in which a plurality of projections (B) are formed on the face back surface; and a subsequent forging step in which a plurality of projections (A) lower than the projections (B) are formed by crushing the projections (B).

2. The manufacturing method according to claim 1, wherein N1/N2 is equal to or greater than 1 and equal to or less than 8, wherein in a planar view, a longest transversal line of projection (A) is defined as CL1, and a transversal line which is the longest among transversal lines perpendicular to CL1 is defined as CL2, wherein N1 is a length of the transversal line CL1, and N2 is a length of the transversal line CL2.

3. The manufacturing method according to claim 1, wherein when a height of each of the projections (B) is defined as Hb, and a height of each of the projections (A) is defined as Ha, Hb/Ha is equal to or greater than 1.5 and equal to or less than 15.

4. The manufacturing method according to claim 1, wherein a height Hb of each of the projections (B) is equal to or greater than 0.2 mm and equal to or less than 1.5 mm.

5. The manufacturing method according to claim 1, wherein a height Ha of each of the projections (A) is equal to or greater than 0.03 mm and equal to or less than 0.2 mm.

6. The manufacturing method according to claim 1, wherein when an area of each of the projections (A) in a planer view is defined as Ma, and an area of each of the projections (B) in the planer view is defined as My, the area My is smaller than the area Ma.

7. The manufacturing method according to claim 6, wherein Ma/My is equal to or greater than 1.2 and equal to or less than 20.

8. The manufacturing method according to claim 1, wherein when an arbitrary first direction and a second direction orthogonal to the first direction are defined in a planar view, arrangement regularity of the projections (A) in the second direction is higher than arrangement regularity of the projections (A) in the first direction.

9. The manufacturing method according to claim 8, wherein the first direction is a longitudinal direction; and the second direction is a lateral direction.

10. The manufacturing method according to claim 1, wherein an area Ma of each of the projections (A) in a planar view is equal to or greater than 3 $mm^2$ and equal to or less than 40 $mm^2$.

11. The manufacturing method according to claim 1, wherein when an area of each of the projections (A) in a planar view is defined as Ma, the projections (A) include two or more kinds of projections (A) having the areas Ma substantially different from each other.

12. A manufacturing method of a golf club head comprising:

a first step of producing a face member, the face member including a face surface that is a hitting surface and a face back surface that is located opposite the face surface, and a plurality of projections (A) on the face back surface; and a second step of joining the face member and another member, wherein the first step includes the steps of:

forming a plurality of projections (B) on the face back surface, and forming the projections (A) lower than the projections (B) by crushing the projections (B).

* * * * *